US008035608B2

(12) United States Patent
Bai et al.

(10) Patent No.: US 8,035,608 B2
(45) Date of Patent: Oct. 11, 2011

(54) INVERTER CIRCUIT OF DRIVING A LAMP AND BACKLIGHT MODULE USING THE SAME

(75) Inventors: Shwang-Shi Bai, Tainan County (TW); I-Sheng Lin, Tainan County (TW); Hsiu-Na Hsieh, Tainan County (TW); Shu-Ming Chang, Tainan County (TW)

(73) Assignee: Himax Technologies Limited, Tainan (TW)

( * ) Notice: Subject to any disclaimer, the term of this patent is extended or adjusted under 35 U.S.C. 154(b) by 875 days.

(21) Appl. No.: 12/051,495

(22) Filed: Mar. 19, 2008

(65) Prior Publication Data

US 2009/0237346 A1 Sep. 24, 2009

(51) Int. Cl.
*G09G 3/36* (2006.01)

(52) U.S. Cl. ..... 345/102; 315/291

(58) Field of Classification Search ..... 345/102; 313/483–512; 349/61, 63, 68–70
See application file for complete search history.

(56) References Cited

U.S. PATENT DOCUMENTS

2006/0001385 A1* 1/2006 Lee ..... 315/291
2007/0126372 A1* 6/2007 Huang et al. ..... 315/291

* cited by examiner

*Primary Examiner* — Amare Mengistu
*Assistant Examiner* — Insa Sadio
(74) *Attorney, Agent, or Firm* — J.C. Patents

(57) ABSTRACT

An inverter circuit for driving a lamp and a backlight module using the same are provided. The inverter circuit includes a signal generation module, a switching unit, a first capacitor, a transformer and a first detecting module. The signal generation module generates a pulse width modulation (PWM) signal, wherein the duty cycle of the PWM signal is controlled by a feedback signal and a sensed signal. The switching unit has a control terminal receiving the PWM signal, and has a first current terminal and a second current terminal respectively coupled to a first terminal and a second terminal of the first capacitor. The transformer generates an AC driving signal to the lamp according to a signal variation of the primary winding coupled the first current terminal of the first transistor. The first detecting module generates the sensed signal according to the flowing current of the switching unit.

20 Claims, 4 Drawing Sheets

INVERTER CIRCUIT OF DRIVING A LAMP AND BACKLIGHT MODULE USING THE SAME

BACKGROUND OF THE INVENTION

1. Field of the Invention

The present invention relates to an inverter circuit for driving a lamp and a backlight module using the same, and more particularly, relates to an inverter circuit utilizing current control mode to drive the lamp.

2. Description of Related Art

With great advance in the techniques of electro-optical and semiconductor devices, flat panel displays, such as liquid crystal displays (LCD), have enjoyed burgeoning development and flourished in recent year. Due to the numerous advantages of the LCD, such as low power consumption, free of radiation, and high space utilization, the LCD has become the main stream in the market. An LCD includes a liquid crystal display panel and a backlight module. The liquid crystal display panel has no capacity of emitting light by itself so that the backlight module is arranged below the liquid crystal display panel to provide the surface light source for the liquid crystal display panel so as to perform the display function.

Generally, a cold cathode fluorescent lamp (CCFL) is often used in the backlight module for providing a backlight. An inverter circuit is needed to generate a driving signal with alternating current (AC) to drive the CCFL. FIG. 1 is a diagram of a conventional inverter circuit. Referring to FIG. 1, the inverter circuit 100 includes a direct current (DC) voltage source 110, a pulse width modulator 120, a bridge DC/AC converter 130, a transformer 140, and a voltage detector 150. The bridge DC/AC converter 130 is a full bridge DC/AC converter and includes the switches S1 through S4, wherein the switches S1 through S4 are implemented by transistors. Herein, the switches S1 and S4 are classified into a set and the switches S2 and S3 are classified into another set. The two sets of switch are alternately conducted according to the control signals CON1 through CON4 generated by the pulse width modulator 120 for converting the DC voltage provided by the DC voltage source 110 into an AC square wave signal with a high frequency.

The transformer 140 and the capacitors C1 and C2 converts the said square wave signal into a quasi-sine wave signal to drive the CCFL 160. Since the luminance of the CCFL 160 is determined according to the amount of current flowing through the CCFL 160, the voltage detector 150 detects a current flowing through the CCFL 160 and converts the current signal into a voltage signal as a feedback signal fb. Hence, the pulse width modulator 120 adjusts the pulse widths of the control signals CON1 through CON4 according to the feedback signal fb for a purpose of steadily adjusting the luminance of the CCFL 160.

Nevertheless, the bridge DC/AC converter 130 of the said inverter circuit 100 uses too many electrical components, e.g. switches S1 through S4, and the incorrect operation of the switches S1 through S4 may cause the inverter circuit 100 failing to drive the CCFL 160. For example, the switches S1 and S2 are conducted simultaneously. Besides, the conventional inverter circuit 100 often utilizes voltage control mode to drive the CCFL 160. The feedback signal fb generated by the voltage detector 150 is utilized to adjust the control signals CON1 through CON4. However, the pulse width modulator 120 can not immediately adjust the pulse widths of the control signals CON1 through CON4 by utilizing such outer loop feedback path. Hence, the factories and stores are giving many efforts to solve the above-mentioned problems.

SUMMARY OF THE INVENTION

Accordingly, the present invention provides an inverter circuit of driving a lamp and a backlight module using the same that can efficiently drive the lamp and steadily strike the lamp by utilizing current control mode.

An inverter circuit for driving a lamp is provided in the present invention. The inverter circuit includes a switching unit, a first capacitor, a transformer, a signal generation module, and a first detecting module. The switching unit has a control terminal receiving the PWM signal for controlling the conductivity of the switching unit, and has a first current terminal and a second current terminal parallel connected to the first capacitor. The transformer has a primary winding coupled to the first voltage and the first current terminal of the switching unit, and has a secondary winding coupled to a second voltage and a lamp. The transformer provides a driving signal with alternating current to the lamp. The signal generation module generates a pulse width modulation (PWM) signal according to the first voltage, wherein a duty cycle of the PWM signal is determined by a feedback signal according to the lamp and a sensed signal. The first detecting module is coupled between the second current terminal of the switching unit and the signal generation module for generating the sensed signal according to the flowing current of the switching unit.

The foregoing inverter circuit further includes a second detecting module in one embodiment of the present invention. The second detecting module is coupled between the lamp and the signal generation module. The second generates the feedback signal according to the flowing current of the lamp.

A backlight module is provided in the present invention. The backlight module includes a lamp and an inverter circuit. The inverter circuit is coupled to the lamp, which provides a light source as a backlight, and is used for driving the lamp. The inverter circuit includes a switching unit, a first capacitor, a transformer, a signal generation module, and a first detecting module. The switching unit has a control terminal receiving the PWM signal for controlling the conductivity of the switching unit, and has a first current terminal and a second current terminal parallel connected to the first capacitor. The transformer has a primary winding coupled to the first voltage and the first current terminal of the switching unit, and has a secondary winding coupled to a second voltage and the lamp. The transformer generates a driving signal with alternating current to the lamp. The signal generation module generates a PWM signal according to the first voltage, wherein a duty cycle of the PWM signal is determined by a feedback signal according to the lamp and a sensed signal. The first detecting module is coupled between the second current terminal of the switching unit and the signal generation module. The first detecting module generates the sensed signal according to the flowing current of the switching unit.

The present invention provides an inverter circuit and a backlight module that utilize current control mode to drive a lamp. As known, the transformer included in the inverter circuit generates the driving signal with AC to drive the lamp according to the signal variation of its primary winding. The sensed signal is generated according to the flowing current of the switching unit and is utilized to control the duty cycle of the PWM signal. When the sensed signal reaches a presetting value, the PWM signal controls the switching unit to be turn off for avoiding over-current and thus increasing the switching efficiency of the switching unit. The feedback path of the sensed signal is an inner closed loop so that not only can immediately adjust the PWM signal, but also the lamp can be driven more efficiently and can be struck steadily.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
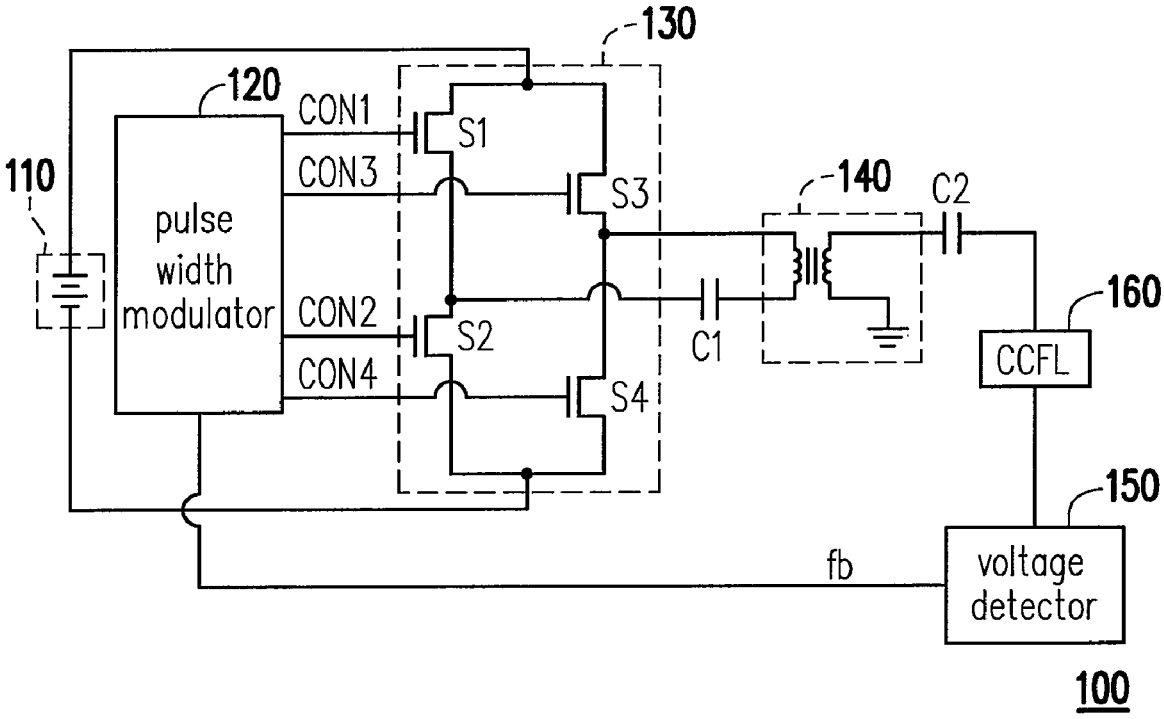
FIG. 1 (PRIOR ART)
FIG. 1 is a diagram of a conventional inverter circuit.
Figure 2:
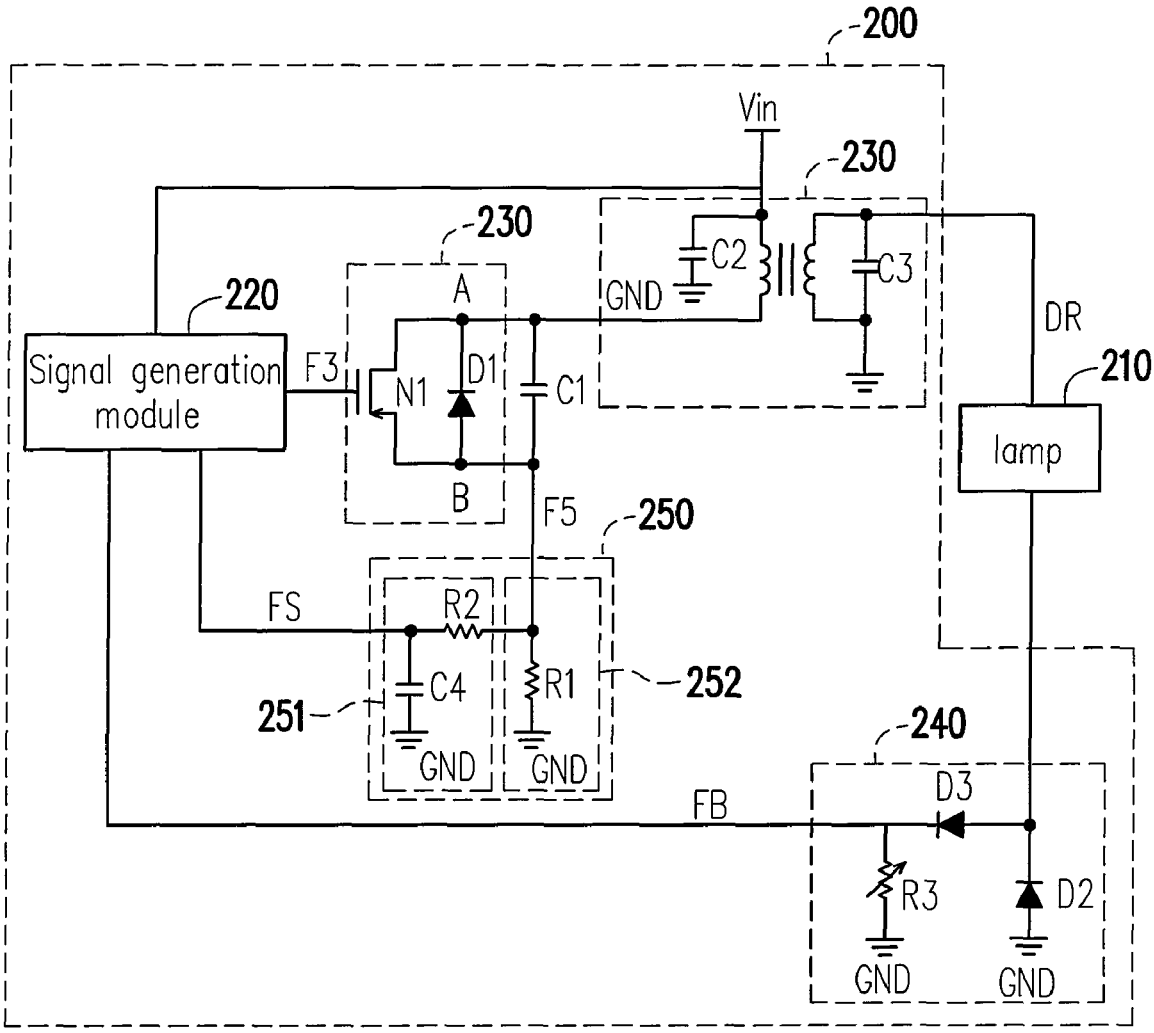
FIG. 2 is a block diagram of a backlight module according to an embodiment of the present invention.

FIG. 2 is a block diagram of a backlight module according to an embodiment of the present invention. Referring to FIG. 2, the backlight module includes an inverter circuit 200 and a lamp 210. It is assumed that the lamp 210 is a cold cathode fluorescent lamp for providing a light source as a backlight. The inverter circuit 200 includes a signal generation module 220, a switching unit 230, a capacitor C1, a transformer 230, a first detecting module 250, and a second detecting module 240. The switching unit 230 has a control terminal receiving a pulse width modulation (PWM) signal F3 for controlling the conductivity of the switching unit 230 and the switching unit 230 has a first current terminal (i.e. the node A) and a second current terminal (i.e. node B) parallel connected to the capacitor C1. In the embodiment, the switching unit 230 is implemented by a N-type transistor N1 and a diode D1 exists in the transistor N1. A gate, a first source/drain and a second source/drain of the transistor N1 are respectively served as the control terminal, the first current terminal and the second current terminal of the switching unit 220. The diode D1 has a cathode and an anode respectively coupled to the first source/drain and the second source/drain of the transistor N1. It is noted that although the N-type transistor N1 is adopted to implement the switching unit 230, any person skilled in the art can utilize other substituted elements to put the embodiment of the present invention into practice, such as P-type transistor or switch.

A primary winding of the transformer 230 is coupled to a first voltage Vin (e.g. a DC voltage) and the first current terminal of the switching unit 230, and a secondary winding of the transformer 230 is coupled to the lamp 210 and a second voltage (i.e. the ground voltage GND herein). According to a signal variation of its primary winding, the transformer 230 generates a driving signal DR with alternating current to drive the lamp 210. The first detecting module 250 is coupled between the second current terminal of the switching unit 230 for generating a sensed signal FS according to the flowing current of the switching unit 230. The second detecting module 240 is coupled between the lamp 210 and the signal generation module 220 for generating a feedback signal FB according to the flowing current of the lamp 210. The signal generation module 220 generates the pulse width modulation (PWM) signal F3 according to the first voltage Vin, wherein a duty cycle of the PWM signal F3 is determined by the feedback signal FB and the sensed signal FS. The following describes the operation of the inverter circuit 200 in detail.

Referring to FIG. 2, the first detecting module 250 includes a resistor unit 252 and a low pass filtering unit 251. The resistor unit 252 is coupled to the second current terminal of the switching unit 230 for converting the flowing current of the switching unit 230 into a voltage signal, that is, the sensed signal FS. The low pass filtering unit 251 is coupled between the resistor unit 251 and the signal generation module 220 for performing a low pass filter process on the sensed signal FS and then transmitting the sensed signal FS to the signal generation module 220. In the embodiment, a resister R1 is adopted to implement the resistor unit 252, wherein a first terminal and a second terminal of the resister R1 are respectively coupled to the second current terminal of the switching unit 230 and the second voltage (i.e. the ground voltage GND). The low pass filtering unit 251 includes a resister R2 and a capacitor C4. The resister R2 has a first terminal and a second terminal respectively coupled to the first terminal of the resister R1 and the signal generation module 250. The capacitor C4 has a first terminal and a second terminal respectively coupled to the second terminal of the resister R2 and the second voltage.

Figure 3A:
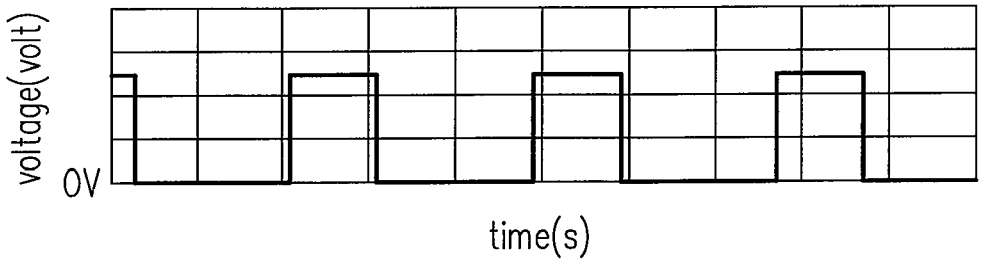
FIG. 3A is a voltage waveform of the pulse width modulation signal according to the embodiment of the present invention in FIG. 2.
Figure 3B:
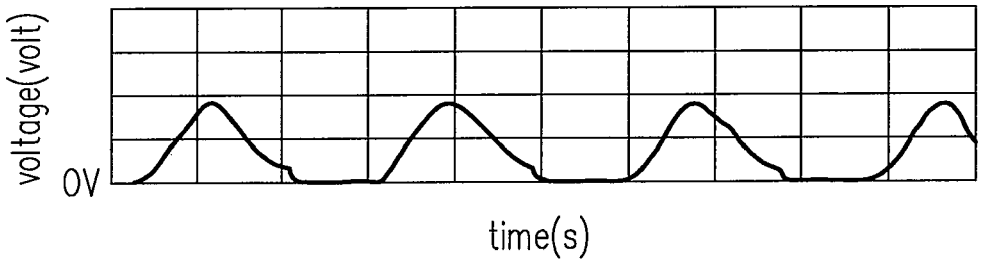
FIG. 3B is a voltage waveform of the first current terminal of the switching unit according to the embodiment of the present invention in FIG. 2.
Figure 3C:
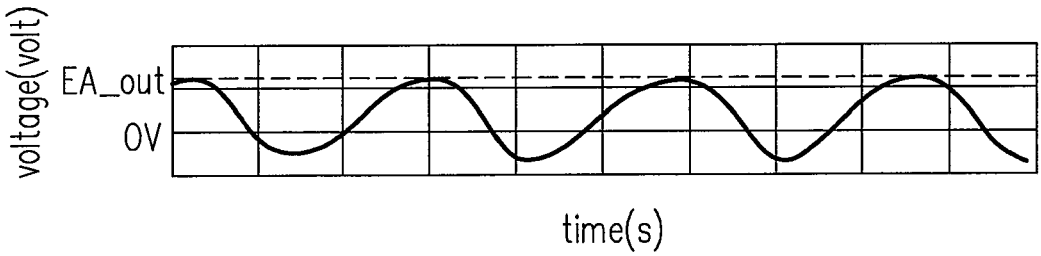
FIG. 3C is a voltage waveform of the sensed signal according to the embodiment of the present invention in FIG. 2.

FIG. 3A, FIG. 3B, and FIG. 3C are the voltage waveforms of the PWM signal F3, the first current terminal of the switching unit 230, and the sensed signal FS respectively according to the embodiment of the present invention in FIG. 2. Referring to FIG. 2, FIG. 3A, FIG. 3B, and FIG. 3C, for convenience of description, the nodes A and B is denoted the first and the second current terminals of the switching unit 230 and the transistor N1 is taken as an example to describe the operation of the switching unit 230. When the PWM signal F3 changes from logic high level ("1") to logic low level ("0"), the transistor N1 is not conducted. A series RLC circuit is composed of the primary winding of the transformer 230, the capacitor C1, and the resister R1 included in the first detecting module 250. When the frequency of the RLC circuit is less than a resonant frequency, the RLC circuit is capacitive so that the first source/drain (i.e. the node A) voltage of the transistor N1 increases. In the meantime, the second source/drain (i.e. the node B) voltage of the transistor N1, i.e. the sensed signal FS, decreases since the current flowing through the resister R1 decreases. When the frequency of RLC circuit is greater than the resonant frequency, the RLC circuit is inductive so that the first source/drain (i.e. the node A) voltage of the transistor N1 decreases. In the meantime, the current direction flowing through the resister R1 is reversed so that the second source/drain (i.e. the node B) voltage of the transistor N1 becomes negative.

When the PWM signal F3 changes from logic low level ("0") to logic high level ("1"), the transistor N1 is conducted. The conducted transistor N1 provides a shortest path that current can pass through. Hence, the first source/drain (i.e. the node A) voltage of the transistor N1 decreases to about 0V, and the second source/drain (i.e. the node B) voltage of the transistor N1 tends to increase linearly. In the embodiment, the resistor unit 252 included in the first detecting module 250 converts the flowing current of the switching unit 230 into the voltage signal, i.e. the sensed signal FS, and feedbacks the sensed signal FS to the signal generation module 220 for controlling the duty cycle of the PWM signal F3. When the sensed signal FS reaches to a presetting value EA_out, the PWM signal F3 immediately changes from logic high ("1") to logic low ("0") for turning off the transistor N1. The feedback path of the sensed signal FS is inner closed loop and the current control mode is utilized herein.

Figure 3D:
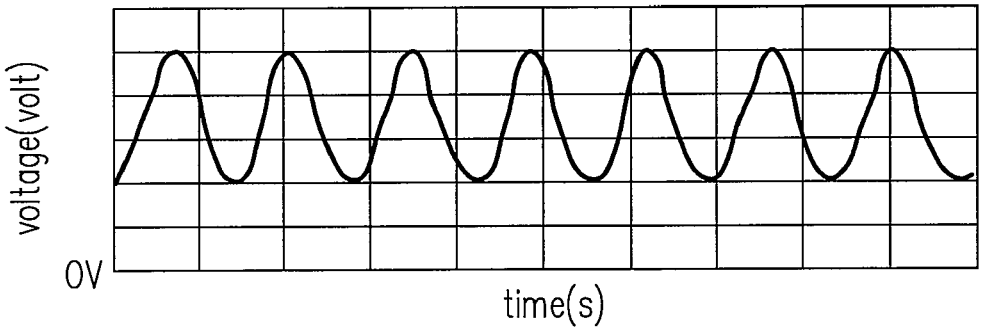
FIG. 3D is a voltage waveform of the feedback signal according to the embodiment of the present invention in FIG. 2.

It is noted that the secondary winding of the transformer 230 induces the signal variation of the primary winding, and generates the driving signal DR with AC through the switching of the switching unit 230. Referring to FIG. 2, the second detecting module 240 includes the diodes D2 and D3, and the variable resister R3. The diode D2 has an anode and a cathode respectively coupled to the second terminal of the lamp 210 and the second voltage (i.e. the ground voltage GND). The diode D3 has an anode and a cathode respectively coupled to the signal generation module 220 and the anode of the diode D2. The variable resister R3 has a first terminal and a second terminal respectively coupled to the anode of the diode D3 and the second voltage. FIG. 3D is a voltage waveform of the feedback signal FB according to the embodiment of the present invention in FIG. 2. Referring to FIG. 2 and FIG. 3D, the current signal flowing through the lamp 210 is rectified via the diodes D2 and D2. According to the voltage division theorem, a voltage across the variable resister R3 is generated, that is, the feedback signal FB. The second detecting module 240 transmits the feedback signal FB to the signal generation module 220 for controlling the duty cycle of the PWM signal F3. The feedback path of the feedback signal FB is outer closed loop and the voltage control mode is utilized herein.

Figure 4A:
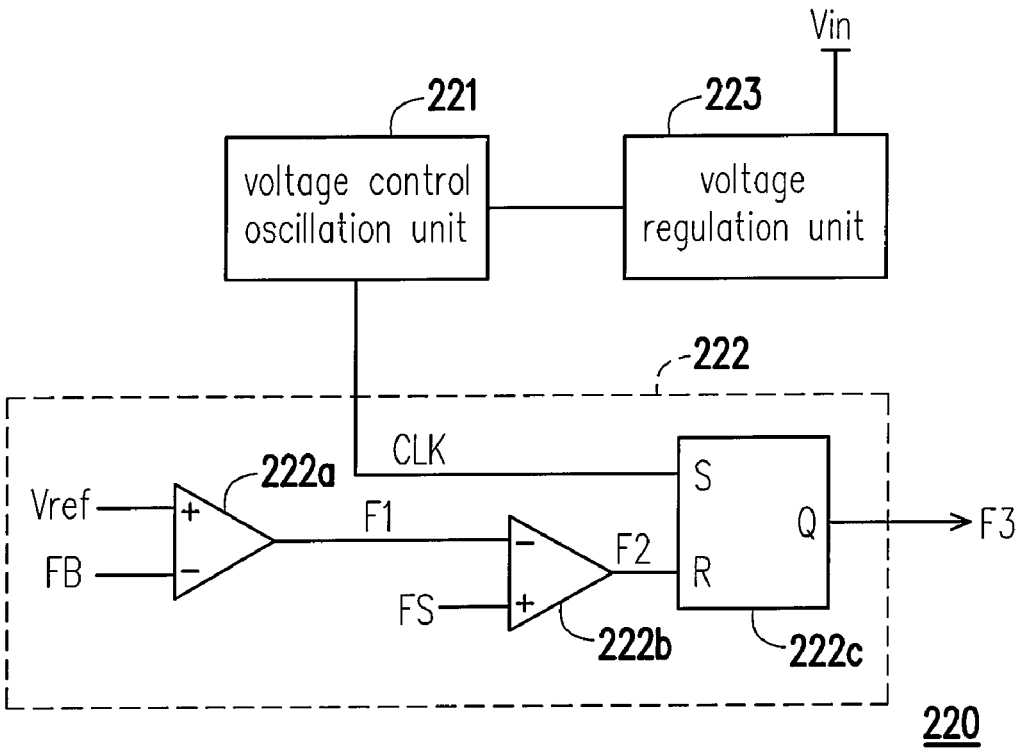
FIG. 4A is a circuit diagram of the signal generation module according to the embodiment of the present invention in FIG. 2.

The following describes how to control the duty cycle of the PWM signal F3 via the sensed signal FS and the feedback signal FB. FIG. 4A is a circuit diagram of the signal generation module 220 according to the embodiment of the present invention in FIG. 2. Referring to FIG. 4A, the signal generation module 220 includes a voltage control oscillation unit 221, a pulse width modulation (PWM) unit 222, and a voltage regulation unit 223. The voltage regulation unit 223 generates a regulated first voltage to the voltage control oscillation unit 221. The voltage control oscillation unit 221 is coupled to the voltage regulation unit 223 for generating a clock signal CLK. The PWM unit 222 includes an error amplifier 222*a*, a comparator 222*b*, and a latch 222*c*. The error amplifier 222*a* receives a reference signal REF and the feedback signal FB, and outputs a first error signal F1. The comparator 222*b* compares the sensed signal FS with the first error signal F1, i.e. the said presetting value EA_out, and outputs a second error signal F2. Then, the latch 222*c* receives the clock signal CLK and the second error signal F2 and thereby generates the PWM signal F3.

Figure 4B:
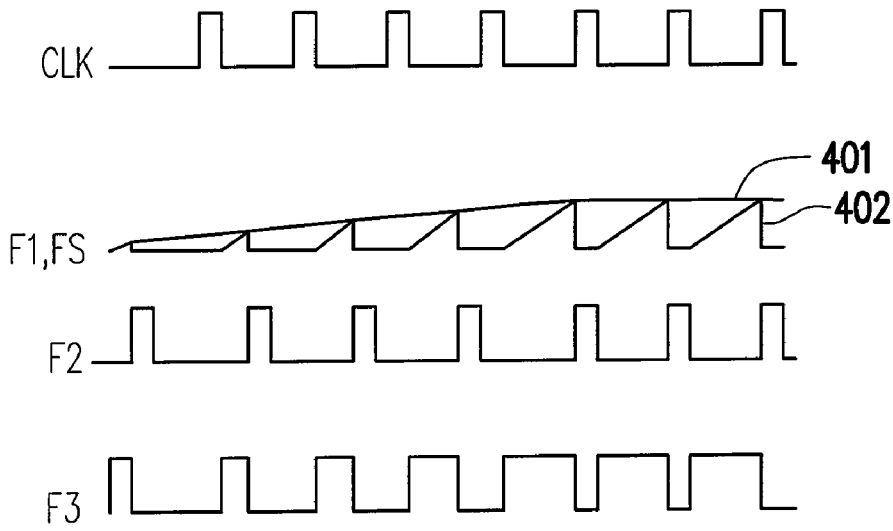
FIG. 4B is a timing diagram of the PWM unit according to the embodiment of the present invention in FIG. 4A.

FIG. 4B is a timing diagram of the PWM unit 222 according to the embodiment of the present invention in FIG. 4A. Referring to FIG. 4B, the curve 401 represents the first error signal F1 and the curve 402 represents the sensed signal FS. The waveform of the first error signal F1 depends on the feedback signal FB and the reference signal REF. In the embodiment, the first error signal F1 can be composed of sine waves with different frequencies according to the error amplifier 222*a*. People ordinarily skilled in the art can utilize other amplifier circuit to implement the error amplifier 222*a*, and the invention is thus not limited to the embodiment.

Referring FIG. 4A and FIG. 4B, when the clock signal CLK is asserted, the PWM signal F3 outputted from the latch 222*c* changes from logic low level ("0") to logic high level ("1") for conducting the transistor N1. In the meantime, the second source/drain (i.e. the node B) voltage of the transistor N1, i.e. the sensed signal FS, tends to increases linearly. When the sensed signal FS reaches the level of the first error signal F1, the second error signal F2 outputted from the comparator 222*b* has logic high level ("1") so that the latch 222*c* is controlled to be reset and then generates the PWM signal F3 having logic low level ("0") for turning off the transistor N1. According to the above-mentioned description, the feedback signal FB responds to the flowing current of the lamp 210, and the feedback signal FB is utilized to check whether the lamp 210 is struck steadily or not. Besides, the sensed signal FS responds to the flowing current of the switching unit 230, and the sensed signal FS is utilized to provide an over-current protection mechanism and increase the switching efficiency of the switching unit 230.

In summary, the said embodiments can generate the driving signal DR with AC to drive the lamp 210 by controlling the switching unit 230 to be turn on/off. The flowing current of the lamp 210 is converted to the feedback signal FB in voltage via the second detecting module 240. Utilizing the feedback signal FB to control the duty cycle of the PWM signal F3 can adjust the flowing current of the lamp 210, and it is so called the voltage control mode. In the said embodiments, the first detecting module 250 is connected to the second current terminal of the switching unit 230 for detecting the flowing current of the switching unit 230 and thereby generating the sensed signal FS. When the sensed signal FS reaches the output of the error amplifier 222*a*, i.e. the first error signal F1, the signal generation module 250 can immediately turn off the switching unit 230 to avoid the over-current and increase the switching efficiency of the switching unit 230. Since the sensed signal FS can responds the flowing current of the switching unit 230, utilizing the sensed signal FS to control the duty cycle of the PWM signal F3 is called current control mode.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. An inverter circuit for driving a lamp, comprising:

a switching unit, having a first current terminal, a second current terminal and a control terminal, the control terminal receiving a pulse width modulation signal for controlling the conductivity of the switching unit;

a first capacitor, parallel connected to the first current terminal and the second current terminal of the switching unit;

a transformer, having a primary winding coupled to a first voltage and the first current terminal of the switching unit and a secondary winding coupled to a second voltage and a lamp for providing a driving signal with alternating current to the lamp;

a signal generation module, for generating the pulse width modulation signal according to the first voltage, wherein a duty cycle of the pulse width modulation signal is determined by a feedback signal according to the lamp and a sensed signal; and a first detecting module, directly connected to the second current terminal of the switching unit and the signal generation module for generating the sensed signal according to the flowing current of the switching unit.

2. The inverter circuit for driving the lamp as claimed in claim 1, wherein the signal generation module comprises:

a voltage control oscillation unit, for generating a clock signal; and a pulse width modulation unit, coupled to the voltage control oscillation unit for generating the pulse width modulation signal according to a frequency of the clock signal.

3. The inverter circuit of driving the lamp as claimed in claim 2, wherein the pulse width modulation unit comprises:

an error amplifier, for outputting a first error signal according to a reference signal and the feedback signal;

a comparator, for outputting a second error signal by comparing the sensed signal with the received first error signal; and a latch unit, for generating the pulse width modulation signal by receiving the clock signal and the second error signal.

4. The inverter circuit for driving the lamp as claimed in claim 2, wherein the signal generation module further comprises:

a voltage regulation unit, coupled to the voltage control oscillation unit for providing a regulated first voltage to the voltage control oscillation unit.

5. The inverter circuit for driving the lamp as claimed in claim 1, further comprising:

a second detecting module, coupled between the lamp and the signal generation module for generating the feedback signal according to the flowing current of the lamp.

6. The inverter circuit for driving the lamp as claimed in claim 1, wherein the first detecting module comprises:

a resistor unit, coupled to the second current terminal of the switching unit for outputting the sensed signal.

7. The inverter circuit for driving the lamp as claimed in claim 6, wherein the first detecting module further comprises:

a low pass filtering unit, coupled between the resistor unit and the signal generation module for performing a low pass filtering process on the sensed signal.

8. The inverter circuit for driving the lamp as claimed in claim 1, wherein the first voltage is a voltage source with direct current.

9. The inverter circuit for driving the lamp as claimed in claim 1, wherein the second voltage is a ground voltage.

10. The inverter circuit for driving the lamp as claimed in claim 1, wherein the lamp is a cold cathode fluorescent lamp.

11. A backlight module, comprising: a lamp, for providing a light source; and an inverter circuit, coupled to the lamp for driving the lamp, comprising:

a switching unit, having a first current terminal, a second current terminal and a control terminal, the control terminal receiving a pulse width modulation signal for controlling the conductivity of the switching unit; a first capacitor, parallel connected to the first current terminal and the second current terminal of the switching unit;

a transformer, having a primary winding coupled to a first voltage and the first current terminal of the switching unit and a secondary winding coupled to a second voltage and a lamp for providing a driving signal with alternating current to the lamp;

a signal generation module, for generating the pulse width modulation signal according to a level of a first voltage, wherein a duty cycle of the pulse width modulation signal is determined by a feedback signal according to the lamp and a sensed signal; and a first detecting module, directly connected to the second current terminal of the switching unit and the signal generation module for generating the sensed signal according to the flowing current of the switching unit.

12. The backlight module as claimed in claim 11, wherein the signal generation module comprises:

a voltage control oscillation unit, for generating a clock signal; and a pulse width modulation unit, coupled to the voltage control oscillation unit for generating the pulse width modulation signal according to a frequency of the clock signal.

13. The backlight module as claimed in claim 12, wherein the pulse width modulation unit comprises:

an error amplifier, for outputting a first error signal according to a reference signal and the feedback signal;

a comparator, for outputting a second error signal by comparing the sensed signal with the received first error signal; and a latch unit, for generating the pulse width modulation signal by receiving the clock signal and the second error signal.

14. The backlight module as claimed in claim 12, wherein the signal generation module further comprises:

a voltage regulation unit, coupled to the voltage control oscillation unit for providing a regulated first voltage to the voltage control oscillation unit.

15. The backlight module as claimed in claim 11, further comprising:

a second detecting module, coupled between the lamp and the signal generation module for generating the feedback signal according to the flowing current of the lamp.

16. The backlight module as claimed in claim 11, wherein the first detecting module comprises:

a resistor unit, coupled to the second current terminal of the switching unit for outputting the sensed signal.

17. The backlight module as claimed in claim 11, wherein the first detecting module further comprises:

a low pass filtering unit, coupled between the resistor unit and the signal generation module for performing a low pass filtering process on the sensed signal.

18. The backlight module as claimed in claim 11, wherein the first voltage is a voltage source with direct current.

19. The backlight module as claimed in claim 11, wherein the second voltage is a ground voltage.

20. The backlight module as claimed in claim 11, wherein the lamp is a cold cathode fluorescent lamp.

* * * * *